US005244005A

United States Patent [19]

Hassan et al.

[11] Patent Number: 5,244,005

[45] Date of Patent: Sep. 14, 1993

[54] DEVICE FOR CAUSING A DROP IN THE PRESSURE OF HIGH PRESSURE OIL CONTROLLING ADMISSION VALVES OF A TURBINE IN THE EVENT OF EXCESS SPEED

[75] Inventors: Alain Hassan, Paris; Jacques Pajot, Lamorlaye, both of France

[73] Assignee: GEC Alsthom SA, Paris, France

[21] Appl. No.: 945,508

[22] Filed: Sep. 16, 1992

[30] Foreign Application Priority Data

Sep. 18, 1991 [FR] France ..... 91 11509

[51] Int. Cl.[5] ..... F01D 17/26

[52] U.S. Cl. ..... 137/56; 137/58; 415/43

[58] Field of Search ..... 137/56, 58; 415/43

[56] References Cited

U.S. PATENT DOCUMENTS

| | | | |
|---|---|---|---|
| 2,646,813 | 7/1953 | Mueller | 137/58 |
| 2,894,521 | 7/1959 | Carleton et al. . | |
| 3,212,260 | 10/1965 | Gardner et al. . | |
| 3,669,559 | 6/1972 | Sakamoto | 415/43 X |
| 3,911,939 | 10/1975 | Stefanek | 137/58 |
| 3,948,478 | 4/1976 | Vind . | |
| 4,103,592 | 8/1978 | Davis . | |
| 4,217,814 | 8/1980 | Wood, Jr. . | |
| 4,337,689 | 7/1982 | Heusler . | |

FOREIGN PATENT DOCUMENTS

| | | |
|---|---|---|
| 0020892 | 1/1981 | European Pat. Off. . |
| 349623 | 12/1960 | Switzerland . |

*Primary Examiner*—Robert G. Nilson

*Attorney, Agent, or Firm*—Sughrue, Mion, Zinn, Macpeak & Seas

[57] ABSTRACT

A device for causing a drop in the pressure of high pressure oil controlling admission valves of a steam turbine in the event of excess speed, the device comprising a speed trip (2) constrained to rotate with the shaft (1) of the turbine and fed downstream from a constriction (5) with low pressure oil from the low pressure lubricating oil circuit of the turbine, the device being characterized in that it comprises a hydraulically controlled valve (9) having a hollow body (23) containing a closing valve member (24) for closing a discharge orifice (12) connected to said high pressure oil circuit, said closing valve member (24) being connected to a plate (25) dividing in sealed manner the inside of the body of the hydraulically controlled valve (9) into two compartments, a "first" one (11) of said compartments being situated on the same side as said discharge orifice (12) and also including at least one evacuation orifice (37), and the "second", other one of the compartments (8) being fed downstream via a feed orifice (7) from a constriction (5) with oil from said low pressure oil circuit, said second compartment (8) being also connected without constriction to said speed trip (2), and in that the moving equipment (10) constituted by said closing valve member (24) and said plate (25) is guided axially by guide means (27, 28, 29), said moving equipment also being subjected to a resilient force (33) tending to move said valve member (2) away from the discharge orifice (12).

2 Claims, 2 Drawing Sheets

Figure 1:
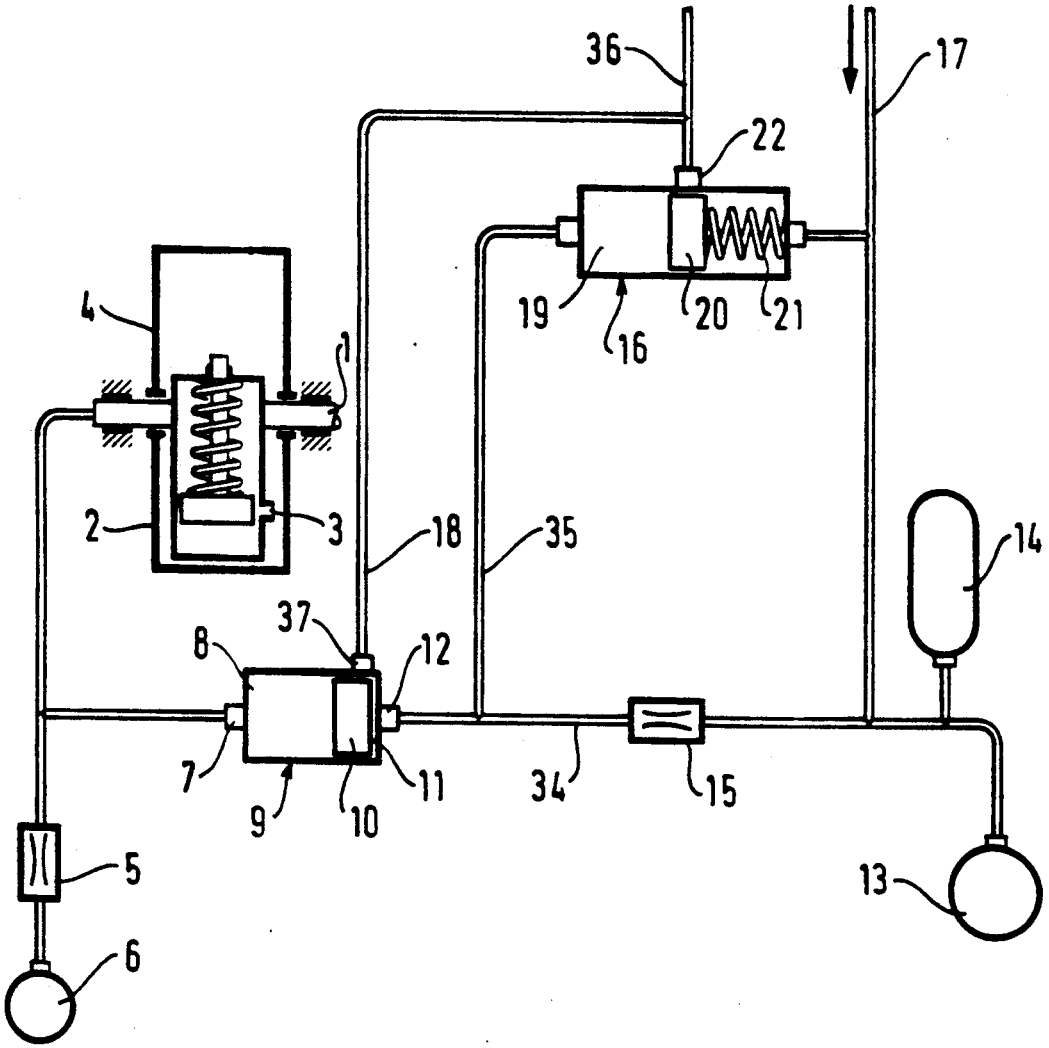

DEVICE FOR CAUSING A DROP IN THE PRESSURE OF HIGH PRESSURE OIL CONTROLLING ADMISSION VALVES OF A TURBINE IN THE EVENT OF EXCESS SPEED

The present invention relates to a device for responding to excess turbine speed by causing a drop in the pressure of the oil that controls the admission valves of a turbine.

The admission valves of a steam turbine are controlled to open by a high pressure oil circuit. A drop in the pressure of this oil circuit causes the valves to close, and consequently causes the turbine to stop.

A safety system exists for the specific purpose of causing the pressure in said high pressure oil circuit to drop very quickly in the event of the turbine going too fast. Excess speed is detected by a speed trip operating on the basis of centrifugal force, and to cause said drop in pressure, the system uses the low pressure lubricating oil circuit and the speed trip is itself filled with lubricating oil. In the event of excess speed, a valve member in the trip opens and the oil escapes, thereby suddenly reducing the pressure of the low pressure lubricating circuit. One or more pressure sensors situated on the circuit then control an electrically controlled valve in the high pressure oil circuit so as to cause the oil pressure to drop suddenly.

A drawback of such a system comes from the fact that in the event of an electricity failure, the turbine runs the risk of being unprotected should its speed become too great.

An object of the invention is to provide the turbine with a mechanical trip system for use on its own or in association with an existing prior art system.

The present invention thus provides a device for causing a drop in the pressure of high pressure oil controlling admission valves of a steam turbine in the event of excess speed, the device comprising a speed trip constrained to rotate with the shaft of the turbine and fed downstream from a constriction with low pressure oil from the low pressure lubricating oil circuit of the turbine, the device being characterized in that it comprises a hydraulically controlled valve having a hollow body containing a closing valve member for closing a discharge orifice connected to said high pressure oil circuit, said closing valve member being connected to a plate dividing in sealed manner the inside of the body of the hydraulically controlled valve into two compartments, a "first" one of said compartments being situated on the same side as said discharge orifice and also including at least one evacuation orifice, and the "second", other one of the compartments being fed via a feed orifice downstream from a constriction with oil from with oil from said low pressure oil circuit, said second compartment being also connected without constriction to said speed trip, and in that the moving equipment constituted by said closing valve member and said plate is guided axially by guide means, said moving equipment also being subjected to a resilient force tending to move said valve member away from the discharge orifice.

In a preferred embodiment, the sealing between said two compartments is provided by a metal bellows.

Figure 2:
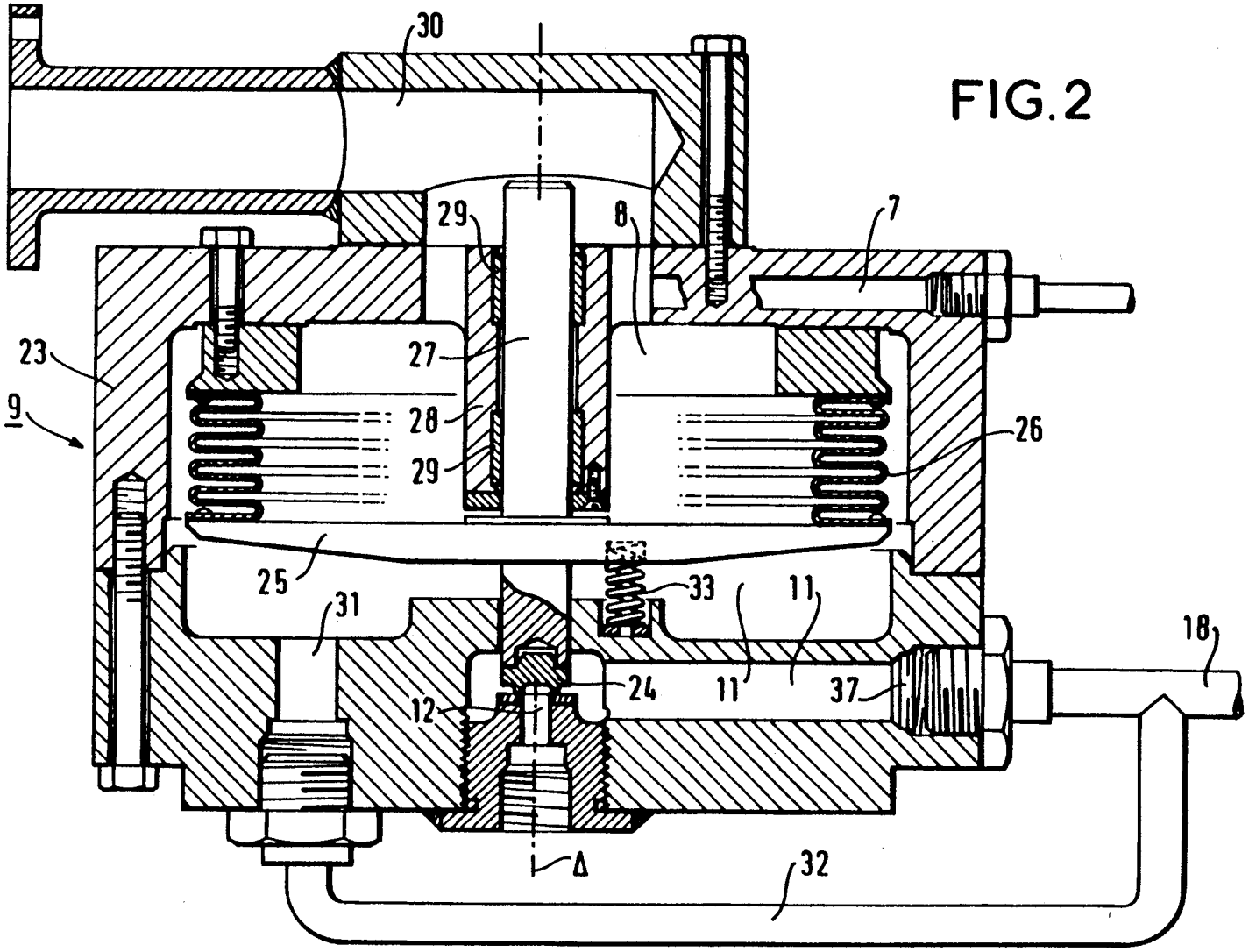

An embodiment of the invention is described below with reference to the accompanying drawings, in which:

FIG. 1 is a diagram showing the fluid circuit of the device of the invention; and FIG. 2 shows a member of the FIG. 1 circuit.

With reference to FIG. 1, there can be seen the shaft 1 of a steam turbine. At its end, this shaft carries a speed trip 2 which is constrained to rotate with the shaft. It is a centrifugal trip in which an orifice 3 is opened in the event of excess speed. The oil contained in the trip then flows out through said orifice 3 and is collected in a cover 4 surrounding the trip. Such a trip is a member that is well known per se. It is fed via a constriction 5 with oil at low pressure, at about 1.5 bars, from the low pressure oil circuit for lubricating the turbine. 6 represents a low pressure feed pump.

Via a feed orifice 7, the low pressure oil circuit also feeds a sealed compartment 8 of a hydraulically controlled valve 9 which has another compartment 11 on the opposite side of moving equipment 10, which other compartment is connected via a discharge orifice 12 to a high pressure (100 bars) oil circuit for controlling the steam admission valves of the turbine. This circuit includes a feed pump 13, a pressure accumulator 14, a constriction 15, and a fast emptying device 16 fed from opposite sides of the constriction 15. Finally, a duct 17 upstream from the constriction 15 is connected to a conventional system for controlling the valves. It is recalled that these valves are held open by the high pressure of the oil in the duct 17.

Operation is as follows: in the event of excess speed, the low pressure oil in the lubricating circuit escapes via the orifice 3, thereby causing the pressure in the compartment 8 to drop. As a result, and as explained below when describing FIG. 2, the moving equipment 10 of the hydraulically controlled valve 9 is displaced, thereby causing high pressure oil to enter the compartment 11 and be removed via a duct 18, thus giving rise to a sudden drop in pressure in the lefthand portion 19 of the fast emptying device 16. Its piston 20 under thrust from a spring 21 disengages an exhaust orifice 22 and the pressure in the duct 17 drops immediately, thereby causing the admission valves to be closed. The drop in the pressure of the high pressure oil in the duct 17 takes place after a delay of one-tenth of a second starting from the low pressure oil discharging through the orifice 3 in the speed trip 2.

FIG. 2 shows the hydraulically controlled valve 9 in detail.

Valve 9 comprises a hollow body 23 having a valve member 24 situated therein for closing a discharge orifice 12 connected to the high pressure oil circuit as can be seen in FIG. 1. This closing valve member is connected to a plate 25 which divides the inside of the body into two compartments which are sealed relative to each other by a metal bellows 26. The first compartment 11 is situated on the same side of the plate 25 as the discharge orifice 12, and the second compartment 8 is included on the other side of the plate 25 inside the metal bellows 26. The valve member 24 and the plate 25 are connected to each other and constitute the moving equipment 10 that is axially movable along the axis Δ. The axial movement is guided by a rod 27 connecting the closing valve member 24 to the plate 25, which rod slides in a bearing 28 provided with bronze rings 29. The second compartment 8 is fed with low pressure lubricating oil via a feed orifice 7. As shown in FIG. 1, this feed orifice 7 is disposed downstream from a constriction 5. This second compartment 8 also includes another opening 30 for connecting it to the speed trip 2 which is thus also fed downstream from the constriction 5. Naturally, the connection between the valve 9 and the speed trip 2 takes place via a duct of large section and without any constriction.

The first compartment 11 also includes an evacuation orifice 37. This evacuation orifice is in parallel with an additional orifice 31 which is connected to the orifice 37 by a duct 32.

Given the area of the plate 25 relative to the area of the closing valve member 24, the moving equipment constitutes an amplifier between high pressure oil at 100 bars and low pressure oil at 1.5 bars. Three springs 33 (of which only one is visible in the figure) are also included in the device. These springs tend to open the valve member 24.

When there is no excess speed, the pressure of 1.5 bars is maintained in the second compartment 8 and by being applied against the plate 25, this pressure holds the valve member 24 against the discharge orifice 12 with a force greater than the force acting in the opposite direction and resulting firstly from the force provided by the three springs 33 and secondly from the force due to the pressure of the high pressure oil in contact with the closing valve member 24. A certain flow rate is maintained for the low pressure oil in order to compensate for permanent leakage in the circuit, in particular leakage past the sealing rings on the speed trip 2. In the event of a trip taking place, due to excess speed, the low pressure oil flows through the orifice 3 of the trip 2 and the pressure in the second chamber 8 decreases immediately, with the force on the plate then being insufficient for overcoming the forces due to the springs and to the high pressure. The three springs are designed to travel with the moving equipment after the valve member has been lifted off its seat.

After the valve member has lifted, the high pressure oil escapes towards the duct 18 and the pressure decreases immediately in the downstream ducts 34 and 35 and in the chamber 19 of the fast emptying device 16. The spring 21 then pushes back the piston 20 and the oil escapes via the duct 36, thereby causing the pressure in the duct 17 connected to the system for controlling the admission valves to decrease immediately. The admission valves close immediately.

The purpose of the constriction 15 is to limit the flow in the event of a trip, thereby enabling the pressure to drop suddenly.

We claim:

1. A device for causing a drop in the pressure of high pressure oil controlling admission valves of a steam turbine in the event of excess speed, the device comprising a speed trip (2) constrained to rotate with the shaft (1) of the turbine and fed downstream from a constriction (5) with low pressure oil from the low pressure lubricating oil circuit of the turbine, the device being characterized in that it comprises a hydraulically controlled valve (9) having a hollow body (23) containing a closing valve member (24) for closing a discharge orifice (12) connected to said high pressure oil circuit, said closing valve member (24) being connected to a plate (25) dividing in sealed manner the inside of the body of the hydraulically controlled valve (9) into two compartments a "first" one (11) of said compartments being situated on the same side as said discharge orifice (12) and also including at least one evacuation orifice (37), and the "second", other one of the compartments (8) being fed downstream via a feed orifice (7) from a constriction (5) with oil from said low pressure oil circuit, said second compartment (8) being also connected without constriction to said speed trip (2), and in that the moving equipment (10) constituted by said closing valve member (24) and said plate (25),is guided axially by guide means (27, 28, 29), said moving equipment also being subjected to a resilient force (33) tending to move said valve member (2) away from the discharge orifice (12).

2. A device according to claim 1, characterized in that the sealing between said two compartments (11, 8) is provided by a metal bellows (26).

* * * * *